United States Patent [19]

Jerling et al.

[11] 4,068,447

[45] Jan. 17, 1978

[54] METHOD AND AN APPARATUS FOR PREPARING A PLATFORM FOR BOTTOM CASTING

[75] Inventors: Curt Jerling, Sundbyberg; Hans Olsson, Stockholm; Torgny Veiback, Bandhagen, all of Sweden

[73] Assignee: Norbergs Mekaniska Verkstads AB, Norberg, Sweden

[21] Appl. No.: 681,930

[22] Filed: Apr. 30, 1976

[30] Foreign Application Priority Data

May 6, 1975 Sweden ..... 7505278

[51] Int. Cl.[2] ..... E04G 21/00

[52] U.S. Cl. ..... 52/749

[58] Field of Search ..... 52/749; 110/1 C; 214/1 BC, 6 C, 1 SW; 249/15, 16

[56] References Cited

U.S. PATENT DOCUMENTS

| | | | |
|---|---|---|---|
| 3,782,047 | 1/1974 | Stolz | 52/749 |
| 3,640,046 | 2/1972 | Anderson | 52/749 |

*Primary Examiner*—John E. Murtagh

*Attorney, Agent, or Firm*—Pollock, Vande Sande & Priddy

[57] ABSTRACT

Platforms for bottom casting are prepared prior to the casting operation by charging hollow bricks into a mobile loading member shaped in conformity with the pattern formed by the platform channels and by transferring the bricks to the channels to form runner conduits therein by lowering the loading member bodily into the channels and releasing the bricks onto the channel bottoms.

16 Claims, 4 Drawing Figures

METHOD AND AN APPARATUS FOR PREPARING A PLATFORM FOR BOTTOM CASTING

The present invention relates to a method and an apparatus for preparing a platform having channels formed therein for bottom casting.

Bottom casting is extensively used in the production of high-quality steel. The molten steel is cast into ingot moulds through a system of runners which have to be prepared before each casting operation. The runner system comprises a cast iron runner pipe lined with hollow bricks and a cast iron platform having radially extending channels filled up with hollow bricks defining runner conduits and opening underneath the ingot moulds which are standing upright around the runner pipe. The ingot moulds are kept standing on the platforms from the beginning of the casting operation until the ingots have become solidified, a time span of the order of 2 hours. During this length of time the platform will assume an elevated temperature, and by reason of its great heat capacity and its relatively restricted cooling area the cooling rate is very slow. The platform weight can be estimated at the order of 5000 to 20000 kilograms, and the platform shape may vary widely. Especially when a platform remains stationary between casting operations, heat is conducted to the surrounding ground area which has its temperature raised to about 50° C, and this contributes to make the heat strain on a workman preparing the platform for a following casting operation very great, the platform temperature being of the order of 200° C.

In the customary way the preparation of the platform before casting is effected by clearing it from the runner assembly used in the preceding casting operation, said assembly comprising sand, mortar, bricks and steel solidified in the runner conduits or having escaped by leakage. This clearing work is very dusty and arduous. In a following step the sand covering the channel bottoms may be replenished, and this will cause the raising of more dust. Hollow bricks are then laid in the platform channels. The bricks weighing 3 to 10 kilograms each are laid one at a time in interlocking fore and aft relationship. For an ordinary platform about 30 bricks are required. This operation is made particularly wearisome on account of the elevated platform temperature, about 200° C, excluding the use of knees or hands for supporting the body, the work being carried out at a crouching posture with thick-soled clogs as footwear. Beyond this working posture being extremely trying for the arms, the legs and the back, the heat strain from the platform is an additional incommoding factor. The heat stress at this work has been measured to be about 80% HSI (Heat Stress Index) or 25° CET (Corrected Effective Temperature), which signifies that the heat stress is close to the level at which body temperature cannot be kept normal any more.

After the bricks have been laid in the platform channels sand may be filled into the interspaces, and in some cases mortar is applied onto the bricks. Finally, the runner pipe and the ingot moulds are mounted in their operative positions.

It is an object of the invention to provide a method and an apparatus for preparing platforms for bottom casting by which the aforedescribed drawbacks and particularly the strain pertaining to the laying of the hollow bricks in the platform channels are eliminated. This object is attained by employing a method and an apparatus having the characteristics set out in the appended claims.

An embodiment of the invention will be described by way of example hereinafter, reference being had to the drawings.

In the drawings

Figure 2:
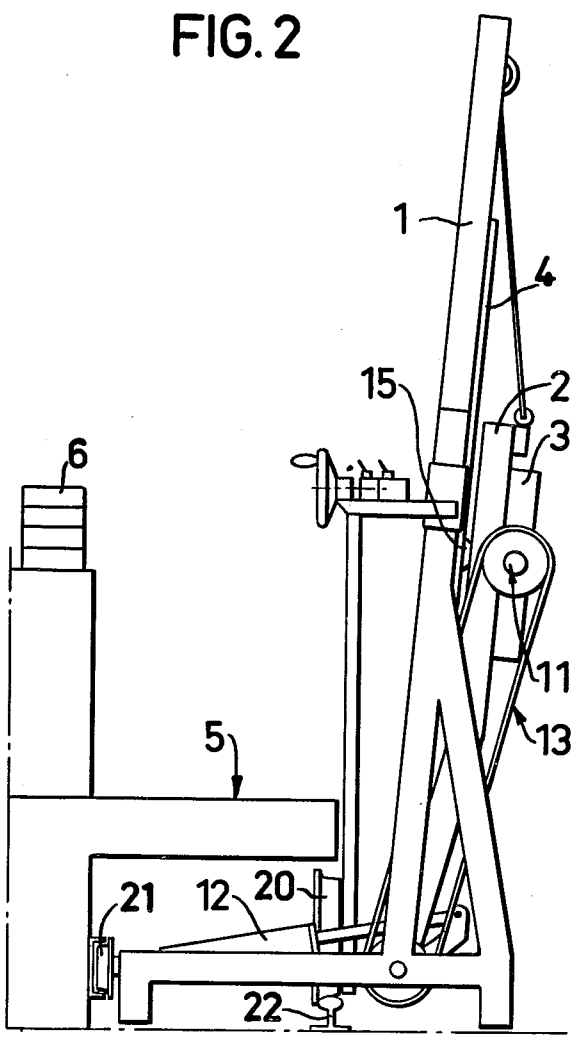
FIG. 2 is a side elevation view of the same apparatus.
Figure 1:
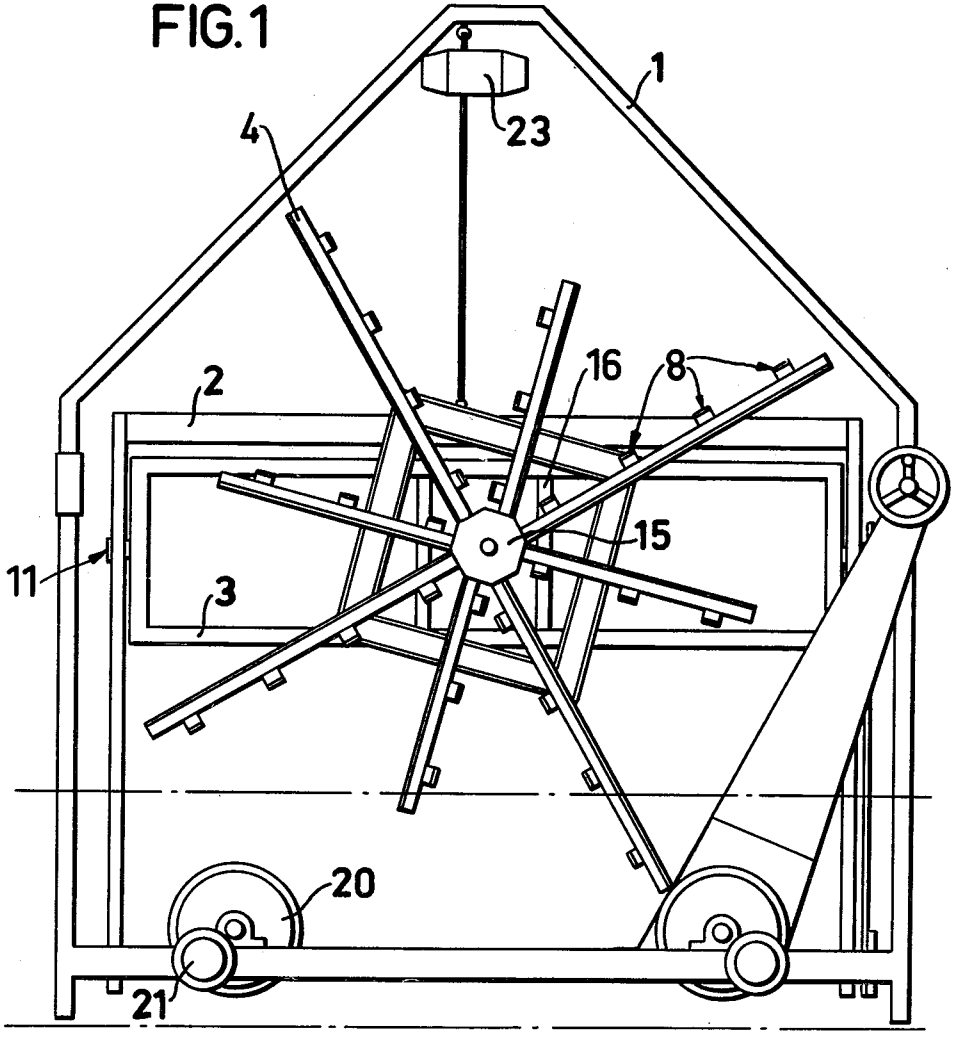
FIG. 1 is a front elevation view of a bricklaying apparatus.

The bricklaying apparatus illustrated in FIGS. 1 and 2 comprises a supporting frame 1, a hoisting arm 2, a fulcrumed yoke 3 and a loading member, the main parts of which comprise spider arms 4 extending radially from a central hub 15. In this embodiment the frame 1 is supported by wheels 20, 21 running along a track 22, to permit lateral travel of the bricklaying apparatus. The spot at which the operator charges the spider arms 4 of the loading member with bricks can be distant from the casting platform, therefore. A single bricklaying apparatus can serve several platforms situated along the track. The operator will stand on a bridge 5, having the bricks 6 close at hand. With the loading member set in a position such as illustrated in FIG. 1, the operator commences with the central brick which may be secured by a central boss or along its edges or by being clamped with a spring clamp. Thereafter the hollow bricks are laid in the spider arms 4 located above a horizontal line passing throught the hub 15 of the loading member.

Figure 3:
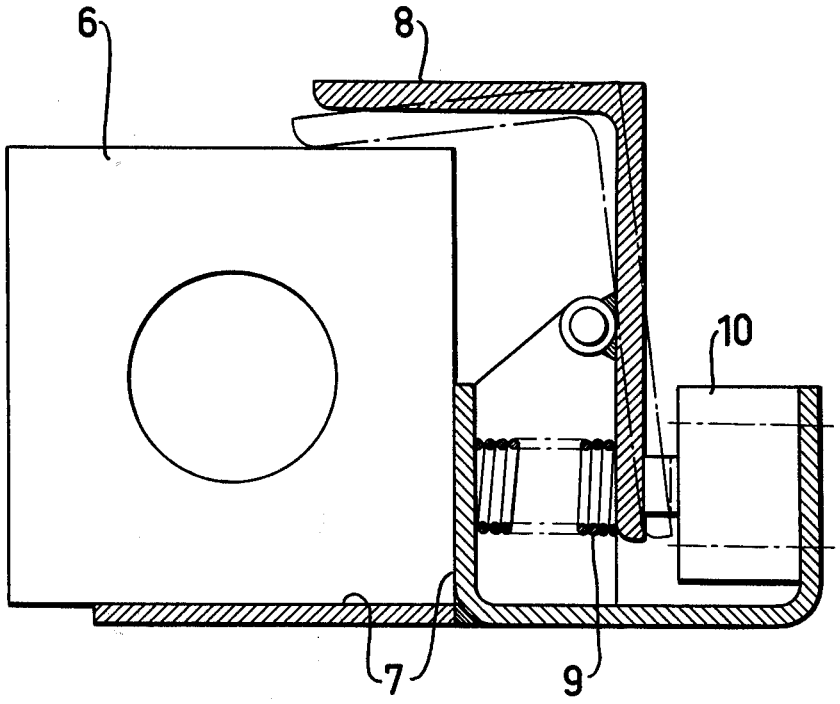
FIG. 3 is a cross section view of an arm belonging to a loading member.

FIG. 3 is a cross section view of a spider arm. A brick 6 rests on an L-shaped portion 7 of the spider arm. The loading member is slightly inclined (FIG. 2) to facilitate the placing of the bricks and to keep them steady in the rows formed. When the upper spider arms have been charged with bricks, the latter are secured in their proper positions by means of clamping members.

The clamping members may be such as those illustrated in FIG. 3. The brick 6 is clamped to the L-shaped member 7, extending longitudinally of the spider arm, by a clamping member 8 biassed by a compression spring 9. When the clamping action shall be suspended the spring force is counteracted by admitting pressurized air into an air capsule 10. The forces acting on the clamping members may be provided by other operating means, e.g. by having the air capsules themselves exert the clamping force, or by a power source common to several clamping members, the force being transmitted through levers, pushrods, rotary shafts or similar means. The power source may equally well be electric or hydraulic.

When bricks have been laid in the spider arms of the uppermost half of the loading member the latter is turned half a revolution about its central axis, thereby moving the still empty spider arms into the receiving position. This rotation may be actuated by releasing a latch, the loading member then being rotated by the unbalanced weight of the bricks. The rotation can be braked in any suitable manner, for example by an oil cataract or by a friction brake. The latch securing the loading member against rotation may comprise a stud or boss engaging a hole or a shoulder. Alternatively, the latching means may be a brake or a snap-action device.

When the operator has charged the second half of the loading member with bricks and has clamped the bricks to the spider arms he adjusts the angular position of the loading member by rotating it fractionally, if required. The bricklaying apparatus is now conveyed bodily to a position opposite the platform 14.

The loading member 4 carried by the yoke 3 can be tilted from near vertical to a horizontal operative position. This operative position can be attained by the yoke being turned about its fulcrums 11 at the arm 2. The power for this operation can be delivered by a pneumatic cylinder 12 through a chain transmission 13 (FIG. 2). The power source may equally well comprise a hydraulic ram or an electric motor. The chain transmission acts as a parallel guide which keeps the loading member in its horizontal position when lowered into the platform channels.

The loading member carried by the yoke 3 is brought close to the platform 14 by the arm 2 being lowered by means of an electric hoist 23 suspended from frame 1. This movement may be performed by applying hydraulic ram power, instead.

The tilting motion may be attained, as an alternative, by making the yoke 3 travel along guide rods down towards the platform. The final movement, into the platform channels, has to be by way of motion within the hub 15 of the loading member or in the yoke suspension. The activation of the yoke tilting movement may follow in response to a signal from the hoisting of the arm by a limit switch, or manually. Another alternative would be to connect the hoisting of the arm 2 to the pivotal motion of the yoke 3 by means of a transmission, such as a chain transmission. A separate power source for the yoke movement will then become unnecessary.

Figure 4:
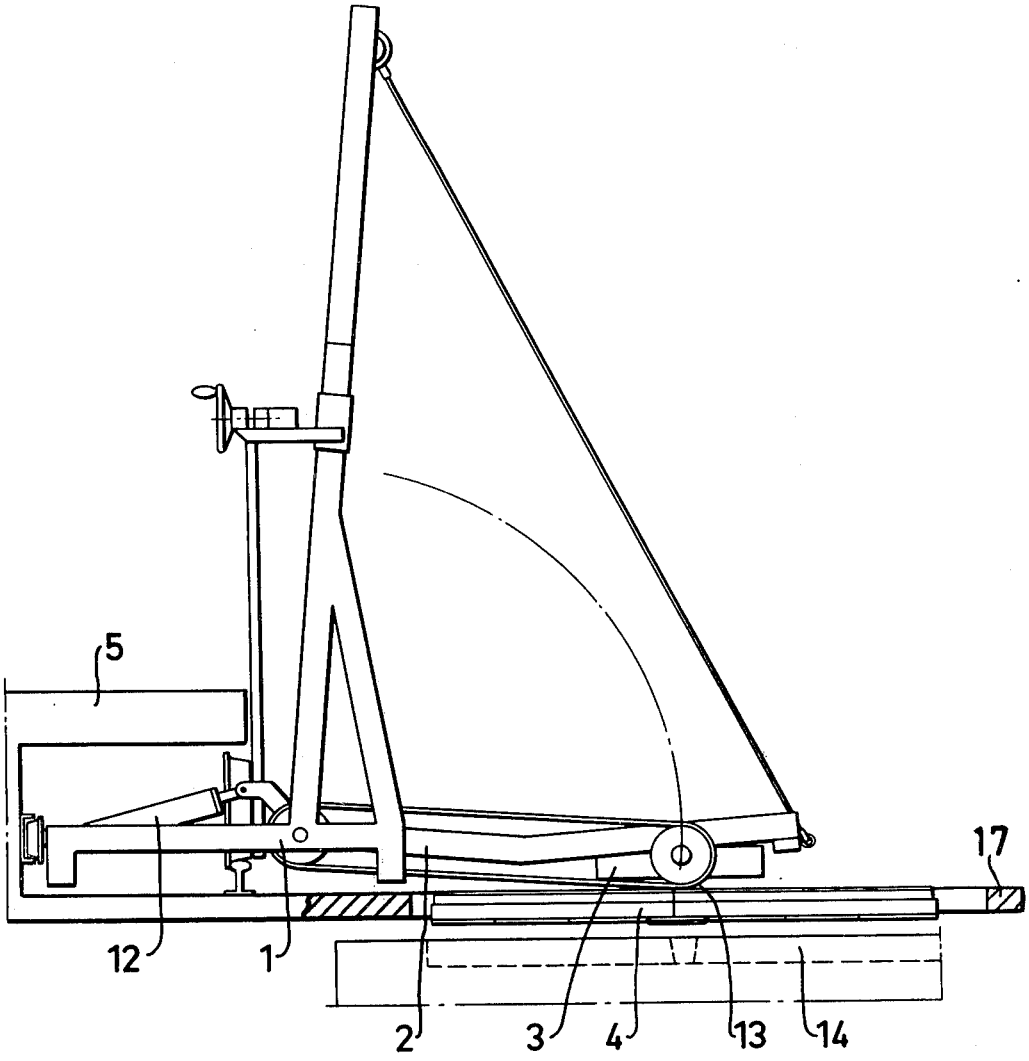
FIG. 4 is a side elevation view of the bricklaying apparatus with the loading member lowered towards the platform.

When the operator has moved the bricklaying apparatus charged with bricks close to the platform 14 and has lowered the loading member into the position illustrated in FIG. 4, he will be able to adjust the loading member to make its spider arms face directly the platform channels. The lateral adjustment is effected by displacing the bricklaying apparatus bodily. At right angles thereto adjustment is possible by the loading member being movable relative to the yoke 3.

This adjustment can be effected by making the hub 15 travel along guides 16 provided at the yoke. This motion may be actuated manually by means of a lever over a link system or cable transmission or by means of pneumatic, hydraulic or electric power.

Guide members aiding the operator in adjusting the loading member relative to the platform channels may be provided at the outer end portions of some spider arms. These guide members may be wedge-shaped and apt to yield when the loading member is lowered into its terminal position within the platform channels. In that position the clamping members 8 are unclamped to release the bricks. The loading member can now be removed and is ready to be charged with a fresh supply of bricks.

The arrangement described above can be improved by the addition of a horizontal heat-insulating screen 17 formed with slits corresponding to the platform channels. The latter can be bought directly opposite the slits in the screen whereby the heat stress is eliminated during sand filling and bricklaying. The screen can be provided with dust evacuating means along the slits to eliminate the dust hazard.

It can be seen that the present invention provides a method and an apparatus permitting a craftsmanlike laying of the bricks in interlocking relation. This is also a prerequisite for good casting conditions. The invention has made it possible, moreover, to carry out the work in an upright posture at easy conditions of reach and mobility. The work is light and does not demand physical strength of the operator. The heat stress can be eliminated in the preparation work, and the whole working area can be designed with suitable aids and equipment items such as lighting, ventilation, anti-noise screens, hoisting equipment, dust evacuation, etc.

As has already been pointed out in several instances, the arrangement disclosed in the specification may be altered or varied in different respects without diverting from the inventive idea expressed in the appended claims.

What we claim is:

1. A bricklaying apparatus for preparing a platform having channel means therein for bottom casting, characterized in that it comprises a supporting frame, a loading member pivotally suspended therein and having arm structures capable of holding bricks forming rows by means of securing and clamping members, means for tilting and lowering or raising the loading member into or away from a horizontal position wherein the bricks are received by said channel means, and means for suspending the action of said securing and clamping members.

2. A bricklaying apparatus as claimed in claim 1, further characterized in that it comprises at least one screen member having slits therein, the slits being coextensive with the platform channel means in the operative relative position of said platform and said screen member.

3. A bricklaying apparatus as claimed in claim 1, characterized in that the frame with the loading member is capable of displacement relative to the platform.

4. A bricklaying apparatus as claimed in claim 1, characterized in that means for tilting the loading member comprise yoke means pivotally supported by the frame and carrying the loading member.

5. A bricklaying apparatus as claimed in claim 1, characterized in that the means for tilting the loading member comprise a pneumatic ram.

6. A bricklaying apparatus as claimed in claim 1, characterized in that the means for tilting the loading member comprise a hydraulic ram.

7. A bricklaying apparatus as claimed in claim 1, characterized in that the means for tilting the loading member comprise an electric motor.

8. A bricklaying apparatus as claimed in claim 7, further characterized in that the means for tilting the loading member comprise a chain transmission.

9. A bricklaying apparatus as claimed in claim 4, characterized in that the loading member is capable of displacement relative to the yoke means.

10. A bricklaying apparatus as claimed in claim 1, characterized in that means for lowering and raising the loading member comprise a hoisting arm pivotally supported by the frame.

11. A bricklaying apparatus as claimed in claim 10 characterized in that the means for lowering and raising the loading member include an electric hoist supported by the frame and operatively connected to the hoisting arm.

12. A bricklaying apparatus as claimed in claim 10, characterized in that the means for lowering and raising the loading member include a hydraulic ram supported by the frame and operatively connected to the hoisting arm.

13. A bricklaying apparatus as claimed in claim 1, characterized in that each arm structure of the loading member is formed with a portion having an L-shaped cross section.

14. A bricklaying apparatus as claimed in claim 1, characterized in that the securing and clamping members comprise clamps pivoted to the arm structures of the loading member.

15. A bricklaying apparatus as claimed in claim 14, characterized in that the securing and clamping members comprise spring means acting on the clamps.

16. A bricklaying apparatus as claimed in claim 14, characterized in that means are provided for releasing the clamps, said releasing means comprising means capable of exerting force upon the clamps to suspend their clamping action.

* * * * *